US008085136B2

(12) United States Patent
Stewart et al.

(10) Patent No.: US 8,085,136 B2
(45) **Date of Patent: *Dec. 27, 2011**

(54) PORTABLE LAP COUNTER AND SYSTEM

(75) Inventors: Gregory M. Stewart, Steilacoom, WA (US); Darwin T. Scott, Albuquerque, NM (US)

(73) Assignee: Orbiter, LLC, Tacoma, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/574,550

(22) Filed: Oct. 6, 2009

(65) Prior Publication Data

US 2010/0019897 A1 Jan. 28, 2010

Related U.S. Application Data

(63) Continuation of application No. 11/627,764, filed on Jan. 26, 2007, now Pat. No. 7,605,685.

(60) Provisional application No. 60/762,975, filed on Jan. 27, 2006.

(51) Int. Cl.
*G08B 23/00* (2006.01)

(52) U.S. Cl. ..... 340/323 R; 340/572.1; 340/573.1; 702/178

(58) Field of Classification Search ..... 340/323 R, 340/572.1, 573.1; 702/178; 368/3, 10
See application file for complete search history.

(56) References Cited

U.S. PATENT DOCUMENTS

| | | | |
|---|---|---|---|
| 5,091,895 | A | 2/1992 | Chatwin |
| 5,140,307 | A | 8/1992 | Rebetez |
| 5,436,611 | A | 7/1995 | Arlinghaus, Jr. |
| 5,511,045 | A | 4/1996 | Sasaki |
| 5,696,481 | A | 12/1997 | Pejas |
| 5,812,049 | A | 9/1998 | Uzi |
| 5,883,582 | A | 3/1999 | Bowers |
| 6,204,813 | B1 | 3/2001 | Wadell |
| 6,340,932 | B1 | 1/2002 | Rodgers |
| 6,496,806 | B1 | 12/2002 | Horwitz |
| 6,512,478 | B1 | 1/2003 | Chien |
| 6,570,487 | B1 | 5/2003 | Steeves |
| 6,577,238 | B1 | 6/2003 | Whitesmith |

(Continued)

OTHER PUBLICATIONS

Saponas, T.S., et al., "Devices That Tell on You: The Nike+iPod Sport Kit," Department of Computer Science and Engineering, University of Washington, Seattle, Nov. 30, 2006, <http://www.cs.washington.edu/research/systems/privacy.html>, 12 pages.

(Continued)

*Primary Examiner* — Brent Swarthout
(74) *Attorney, Agent, or Firm* — Christensen O'Connor Johnson Kindness PLLC

(57) ABSTRACT

A highly portable, vertically-standing RFID tag reader, referred to as a "bollard," is presented. The bollard includes a vertical element supporting an internal RFID tuner component above the surface on which the bollard rests. Additionally, each bollard includes a base element that provides vertical stability to the vertical element and a plurality of internal components. The internal components include the following: a power system, a processor, a tuner component, and a wireless interface. The power system provides power to the powered components of the bollard. The processor directs and/or executes the functions of the bollard with regard to an event in which the bollard is configured to participate. The tuner component is configured to read RFID tags that come within RFID communication range of the bollard. The wireless interface component is configured to provide wireless communications between the bollard and an operator console.

20 Claims, 7 Drawing Sheets

U.S. PATENT DOCUMENTS

| | | | | |
|---|---|---|---|---|
| 6,696,954 | B2 | 2/2004 | Chung | |
| 6,703,935 | B1 | 3/2004 | Chung | |
| 6,720,930 | B2 | 4/2004 | Johnson | |
| 6,812,824 | B1 | 11/2004 | Goldinger | |
| 6,839,027 | B2 | 1/2005 | Krumm | |
| 6,888,459 | B2 | 5/2005 | Stilp | |
| 6,952,157 | B1 | 10/2005 | Stewart | |
| 6,963,270 | B1 | 11/2005 | Gallagher, III | |
| 6,989,750 | B2 | 1/2006 | Shanks | |
| 6,995,655 | B2 | 2/2006 | Ertin | |
| 7,009,526 | B2 | 3/2006 | Hughes | |
| 7,019,639 | B2 | 3/2006 | Stilp | |
| 7,057,511 | B2 | 6/2006 | Shanks | |
| 7,057,975 | B2 | 6/2006 | Stobbe | |
| 7,508,739 | B2 | 3/2009 | Paes | |
| 7,589,616 | B2 | 9/2009 | Klatsmanyi | |
| 7,605,685 | B2 * | 10/2009 | Stewart et al. | 340/323 R |
| 2003/0163287 | A1 | 8/2003 | Vock | |
| 2003/0189484 | A1 | 10/2003 | Rust | |
| 2004/0006445 | A1 | 1/2004 | Paek | |
| 2005/0099269 | A1 | 5/2005 | Diorio | |
| 2006/0020470 | A1 | 1/2006 | Dobbs | |

OTHER PUBLICATIONS

"Alien Advanced RFID Academy," Alien Technology, Mar. 2005, 112 pages.

"Alien RFID Academy," Alien Technology, as early as Sep. 22, 2004, 331 pages.

"Alien Technology RFID Primer," Alien Technology Corporation, 2004, 61 pages.

"Annexe 1: Utilisation des Badgeurs DAG System," Pygmalyon S.A., undated but assumed to be Jul. 19, 2004 [please see NPL Reference #16 for further information about the assumed date], 11 pages.

"Badgeur V2 Sport Version Datasheet," DAG System, Revision 1.0, Jul. 19, 2004, 27 pages.

"EPC™ Generation 1 Tag Data Standards Version 1.1 Rev 1.27," EPCglobal, Standard Specification, May 10, 2005, 87 pages.

"EPC™ Radio-Frequency Identity Protocols Class-1 Generation-2 UHF RFID Protocol for Communications at 860 MHz-960 MHz Version 1.0.9," EPCglobal, Specification for RFID Interface, Jan. 31, 2005, 94 pages.

"EPC™ Tag Data Standards Version 1.1 Rev.1.24," EPCglobal, Standard Specification, Apr. 1, 2004, 78 pages.

"Instructions: System," DAG System™, Version 4, Jul. 9, 2004, 44 pages.

"Instructions: DAG Triathlon," DAG System™, Version 5, Jul. 23, 2004, 23 pages.

"Intermec System Manual: Intermec RFID," Intermec Technologies Corporation, 2005, 74 pages.

Karali, D., "Integration of RFID and Cellular Technologies," Wireless Internet for The Mobile Enterprise Consortium (Winmec), UCLA Anderson School of Management, Technical Report/White Paper UCLA-WINMEC-2004-205-RFID-M2M, Sep. 2004, 23 pages.

"New for 2005—Best Racing Now Uses DAG Chip Timing," DAG, 2005, 5 pages.

O'Connor, M.C., "Alien Debuts Gen 2 Interrogator," RFID Journal, <http://www.rfidjournal.com/article/articleprint/1777/-1/1/1>, Aug. 4, 2005 [retrieved May 3, 2007], 2 pages.

Polster, Leider, Woodruff & Lucchesi, LC, "Summary of Material Prior Art Resulting from a Quick Search," Exhibit I, received Jul. 6, 2011, 2 pages.

Polster, Leider, Woodruff & Lucchesi, LC, "Summary of Material Prior Art Resulting from a Quick Search," Exhibit I, received Jul. 27, 2009, 3 pages.

"Reader Interface Guide: ALR-9780, ALR-9640 v2.1.0," Alien Technology, 2004, 87 pages.

Seshagiri Rao, K.V., et al., "Antenna Design for UHF RFID Tags: A Review and a Practical Application," IEEE Transactions on Antennas and Propagation 53(12):3870-3876, Dec. 2005.

"Trolleyponder/Ecotag RFID Newsletter, No. 51," Jan. 5, 2006, 2 pages.

"Tests on a Timing Module for Sports Timing," Trolley Scan Timing Module Brochure, Trolley Scan (Pty) Ltd, Jun. 2004, 3 pages.

"UHF Gen 2 System Overview," TI-RFid, Texas Instruments, Mar. 2005, 44 pages.

* cited by examiner

PORTABLE LAP COUNTER AND SYSTEM

CROSS-REFERENCES TO RELATED APPLICATIONS

This application is a continuation of application Ser. No. 11/627,764, filed Jan. 26, 2007 now U.S. Pat. No. 7,605,685, which claims the benefit of Provisional Application No. 60/762,975, filed Jan. 27, 2006, both of which applications are expressly incorporated herein by reference.

BACKGROUND

Tracking and timing participants during events, including professional and amateur events such as races, rallies, or simply tracking the number of times a jogger completes a lap around a track, can be automated using RFID (radio frequency identification) technology. In most cases, an RFID reader detects and reads an RFID tag in possession of a tracked participant as the tag passes within reading range of the reader. The RFID reader then sends a record of the tag passing the reader to a central station where information is recorded for the participant. The information that is recorded can vary greatly, but may include location (based on the location of the RFID reader), the time that the tag passed by the reader, or simply that the tag passed the reader (for counting purposes.)

Quite often it is very important the RFID reader be highly portable and as non-intrusive as possible. Using a ski rally as just one example, over the course of the event it is often desirable to configure the routes according to difficulty and skiing conditions. Thus, RFID timing/counting systems that embed wires (acting as antennae) in the ground (or snow), such as systems from AMB, or loop them overhead, such as systems from DAG Systems, are not highly portable and do not permit quick and easy configurability. Moreover, when using wires on the ground as the antennae of an RFID reader, care must be taken to ensure that they do not interfere with the participants. Of course, in making sure that wires do not interfere with the participants, such as embedding the wires substantially below the surface, the reader is no longer very portable. A different solution, offered by Champion Chip, is to incorporate an RFID reader into a mat over which participants must pass. However, as wires embedded in the ground (or snow) can interfere with a participant, a mat can interfere with a participant, especially a skier.

In light of the above, what is needed is a portable RFID timing and counting system that is highly portable and configurable. The present invention addresses these and other issues found in the prior art.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to one embodiment, a highly portable, vertically-standing RFID tag reader, referred to as a "bollard," is presented. The bollard includes a vertical element supporting an internal RFID tuner component above the surface on which the bollard rests. Additionally, each bollard includes a base element that provides vertical stability to the vertical element and a plurality of internal components. The internal components include the following: a power system, a processor, a tuner component, and a wireless interface. The power system provides power to the powered components of the bollard. The processor directs and/or executes the functions of the bollard with regard to an event in which the bollard is configured to participate. The tuner component is configured to read or write to RFID tags that come within RFID communication range of the bollard. The wireless interface component is configured to provide wireless communications between the bollard and an operator console.

According to yet another embodiment of the disclosed subject matter, an event tracking system, for tracking participants in an event using RFID tags, is presented. The event tracking system comprises a plurality of highly portable vertically-standing RFID tag readers (bollards), and operator console, and a base station. The plurality of bollards are configured to record RFID tags of event participants as the pass within communication range of the bollards. The operator console manages an event and its participants according to the information recorded by the plurality of bollards. The base station is communicatively coupled to the operator console and, moreover, the base station is communicatively coupled to at least some of the plurality of bollards via wireless communications.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
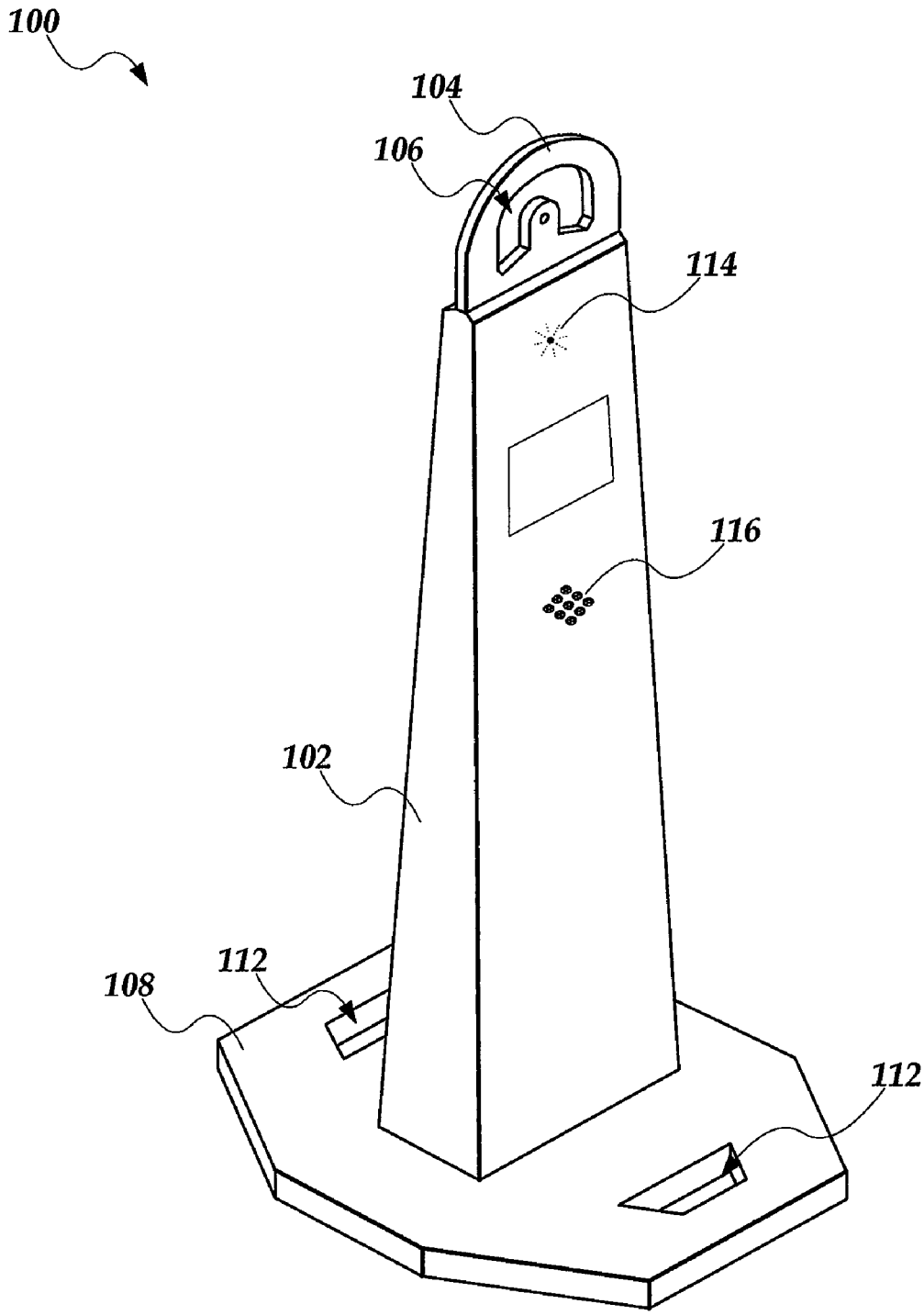
FIG. 1 is a pictorial diagram illustrating an exemplary portable RFID reader formed in accordance with aspects of the present invention.

In accordance with one embodiment, a vertical portable RFID reader, referred to as a "bollard," is presented. As illustrated in FIG. 1, a bollard 100 comprises a vertically rectangular element 102 narrowing from its base towards the top. On top of the rectangular element 102 is an arched portion 104 that includes an opening 106 for a hand to grasp for easy maneuverability and placement. The illustrated bollard 100 includes a removable base 108, the base providing stability to the bollard for standing vertically. In one embodiment, the rectangular element 102 has a flange 110 at its base for preventing the rectangular element from being pulled out of or through the removable base 108. As illustrated, the removable base 108 provides includes optional openings 112 for holding and moving the bollard.

While the vertical element of the bollard 100 is illustrated as a rectangular element narrowing from the base to its top, it should be appreciated that this is just one configuration for this portion of the bollard. In alternative embodiments, the vertical element may comprise a non-tapering cylinder, a cone, and the like. Accordingly, while described as a vertical rectangular element 102, it should be appreciated that this is illustrative only and not intended as limiting upon the disclosed subject matter. Additionally, while the bollard 100 is illustrated as including a removable base 108, this is illustrative only and should not be construed as limiting upon the disclosed subject matter. In an alternative configuration, anticipated as falling within the scope of the disclosed subject matter, the bollard's vertical element 102 and base 108 could be integrated and/or molded as a single unit.

As shown in FIG. 1, each bollard 100 also optionally includes at least one light source, such as an LED 114, and an audio speaker 116 for providing audio and visual feedback from the bollard. For example, the bollard 100 may provide audio and visual feedback via the LED 114 and speaker 116 indicating that an RFID tag has been read. Of course, each bollard 100 may be further configured to provide enhanced audio and visual indications reflecting situations such as a last lap, the current lap, that an RFID tag is rejected, and the like. While not shown, a bollard 100 may be configured with a light source and speaker on opposing broad sides of the rectangular element 102 in order to provide a wider area of feedback regarding reading RFID tags to both participants (those carrying candidate RFID tags) and observers.

Figure 2:
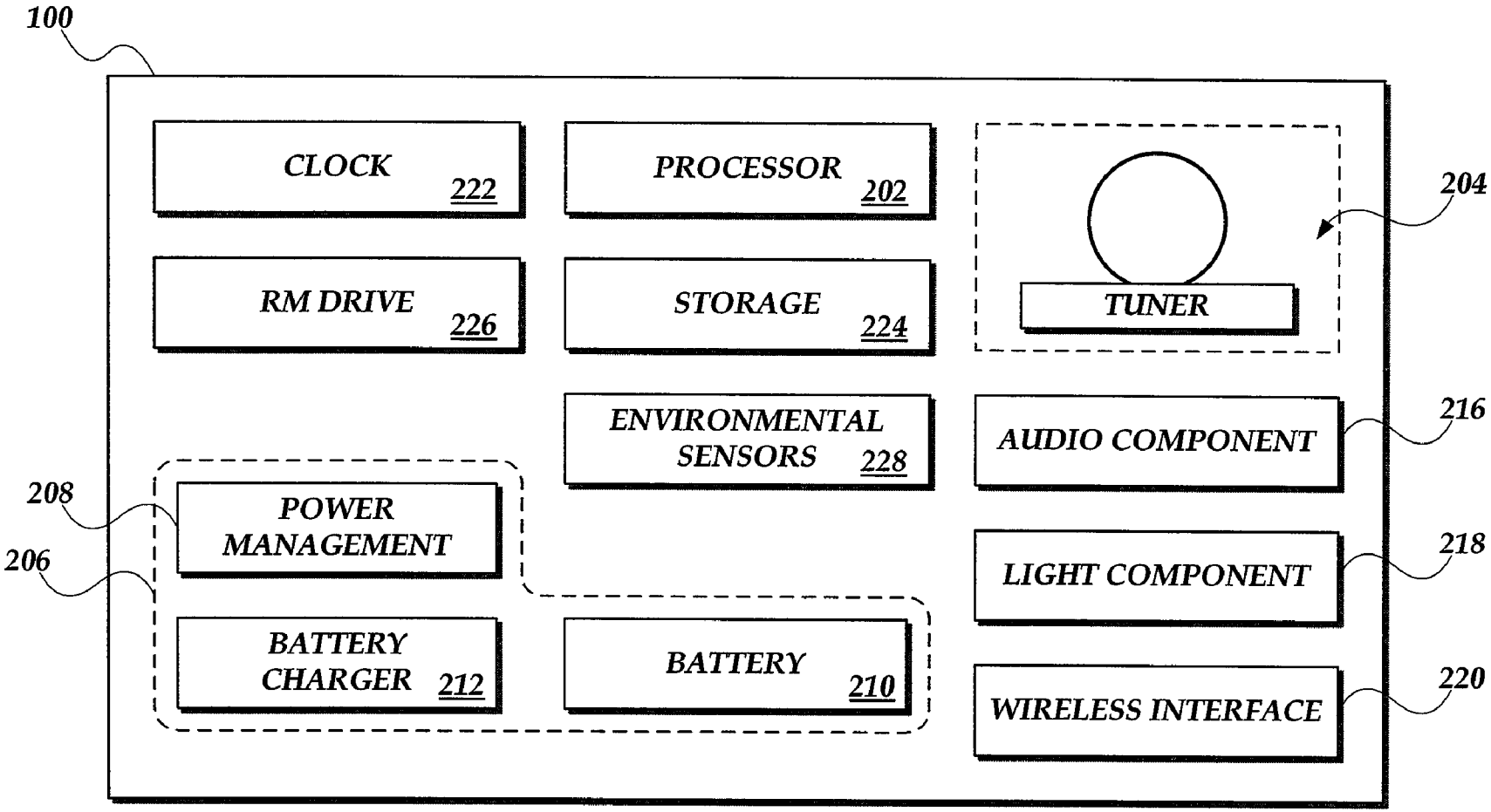
FIG. 2 is a block diagram illustrating components of an exemplary portable RFID reader formed according to aspects of the present invention.

Turning now to FIG. 2, internally, each bollard 100 includes a processor 202 for carrying out the various functions of the bollard, a tuner component 204 for reading from and possibly writing to RFID tags, and a power system 206. With regard to the tuner component 204, while various frequencies may be employed, in at least one embodiment, the tuner component is configured to operate in the 13.56 MHz frequency. In addition to communicating with RFID tags that fall within communication range of the bollard 100, the tuner component 204 may be further or alternatively configured to receive radio wave signals from radio wave transmitting devices. By way of example and not limitation, a bollard 100, via its tuner component 204, may be configured to receive and record information from devices that actively transmit radio wave signals, including wireless telephones, GPS-enabled wireless phones, PDA/cell phone hybrid devices, Bluetooth and/or ZigBee devices, iPod transmitters, and the like.

The power system 206 includes a power management component 208, a battery 210 for providing power to the bollard's components, and a battery charger 212 for charging the battery. The battery charger includes an AC interface (not shown) for connecting the bollard to an AC source. Moreover, the power management component 208 may optionally be configured to operate via the external AC current source.

In one embodiment, the power system 206 supplies power to the bollard in five distinct states: wake, cold battery wake, standby sleep, deep sleep, and off. The off state, as the name suggests, is when the power system 206 component does not supply power to the remaining components. In wake and cold battery wake, the bollard is fully operational and will perform all of its functions, including maintaining, if possible, contact with an operator console (as will be described in greater detail below in regard to FIGS. 3A-3C.) The difference in operation between wake and cold battery wake is that, under cold battery wake, certain power-consuming operations are performed sequentially rather than in parallel. The power management component 208 places the bollard in cold battery wake state when the estimated temperature, as determined by the environmental sensors 214, falls below a certain threshold and no external AC power source is applied to the power system 206.

The bollard 100 is placed in standby sleep state from either wake or cold battery wake states under the following conditions: a standby maintenance RFID tag is detected by the tuner component 204, a physical or electronic standby switch (not shown) is closed, or a standby command is received from an operator console. In standby sleep state, the bollard 100 minimizes power consumption including suspending all event functions, such as reading RFID tags, and will not attempt to contact the operator console. In standby sleep state, the bollard 100 will, periodically (such as on five or ten minute intervals), check for conditions that will allow it to exit standby sleep state and enter wake or cold battery wake states. The bollard 100 cannot exit standby sleep state if a physical or electronic switch is closed. Otherwise, the bollard 100 will exit standby sleep state when an AC power source is applied or the current time falls within a threshold preceding an event in which the bollard is to participate. When transitioning from standby sleep state to one of the wake states, the bollard 100 may transmit an indication of the transition to the operator console. In addition to preserving battery power when not in active use, the standby sleep state is beneficially used when the bollard 100 must be moved from one location to another.

From wake, cold battery wake, and standby sleep states, if the battery voltage falls below a low-battery threshold, if a deep sleep maintenance RFID tag is read, or a command is received to enter deep sleep, the bollard 100 enters a deep sleep state. Once the deep sleep state is entered, all bollard systems are powered off except to periodically determine whether conditions have changed. The conditions change when no deep sleep maintenance RFID tag is no longer present, an AC power source is applied, and the battery voltage falls above the low-battery threshold. Of course, the deep sleep state provides various beneficial functions to the bollard 100: it protects the battery 210 from a deep discharge; prevents the bollard from performing anomalously due to low power voltages; and permits the bollard to remain inactive for long periods of time without detriment to the bollard.

Other components of the bollard 100 include an audio component 216, corresponding to the speaker 116 discussed above, for providing audio feedback as to the operation of the bollard, a light component 218 for providing visual feedback of the operation of the bollard and corresponding to the LED 114, and a wireless interface 220 for wirelessly connecting the bollard to the operator console or other bollards, as will be described in greater detail below. Still other components of the bollard 100 include a clock 222 that may optionally include its own battery for continued operation during standby and deep sleep states, storage 224 for storing information regarding the bollard, the events the bollard is participating in, as well as information regarding RFID tags as they are read by the bollard. An environmental sensors component 228 is provided to read various settings, such as temperature, battery voltage, etc., of both the bollard 100 as well as the environment in which the bollard is located. An optional removable media drive 226 may be used to transfer information, such as records of RFID tags read and stored in the storage 224, to and from an operator's console or other external device.

Each bollard 100 is also configured with an anti-collision protocol that enables the bollard to read information from several tags simultaneously falling within the read range of the tuner components 204.

Figure 3A:
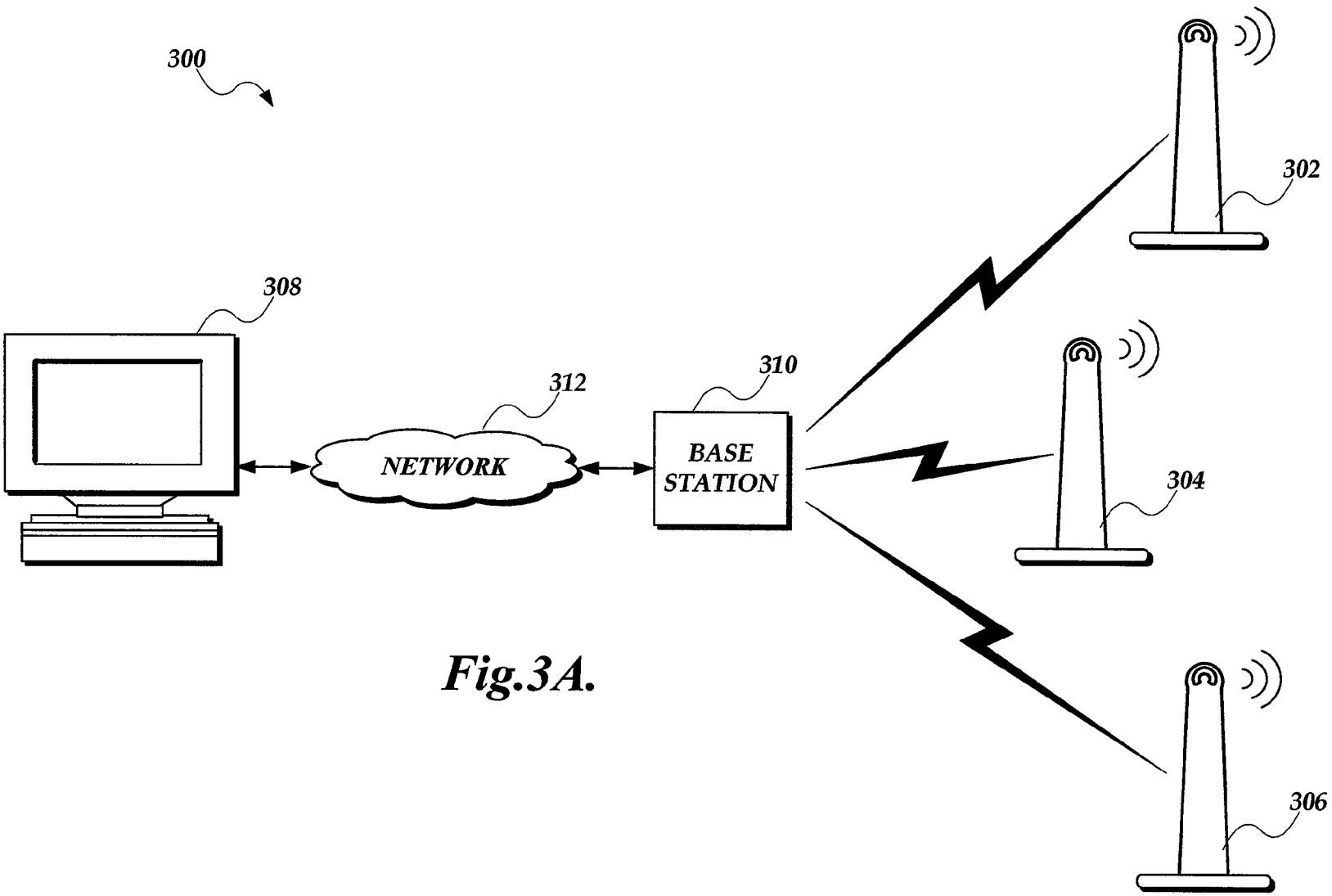
FIGS. 3A-3C are pictorial diagrams of illustrative configurations of a tracking system formed in accordance with aspects of the present invention.
Figure 3B:
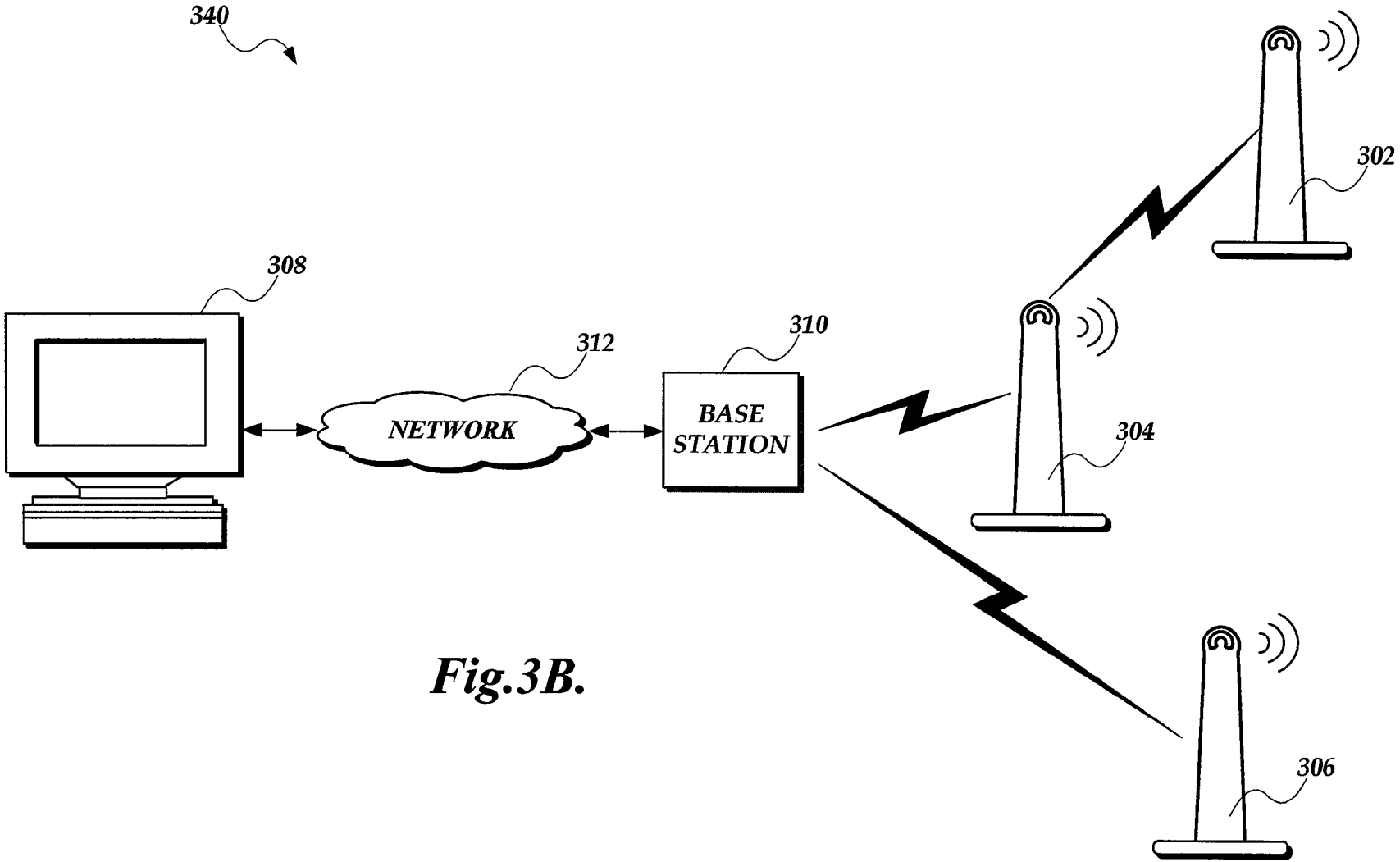
Figure 3C:
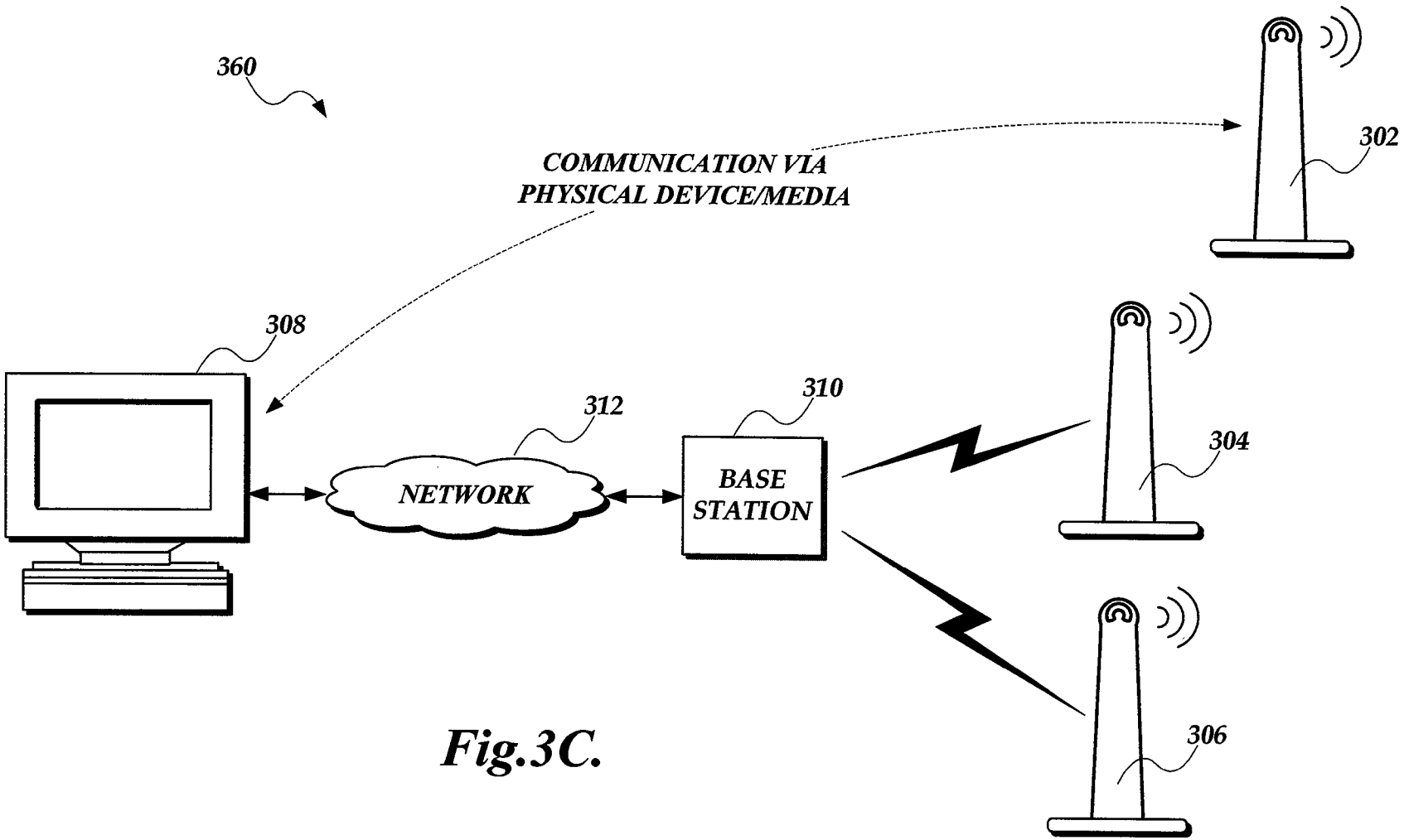

Due the portable nature of each bollard 100, as well as the various features offered by each bollard, a variety of RFID tracking systems for carrying out rallies, races, etc., may be implemented. FIGS. 3A-3C are pictorial diagrams illustrating various tracking system configurations and further illustrating various communications aspects with regard to use of the bollards. More particularly, in regard to FIG. 3A, an illustrative tracking system 300 including three bollards, bollards 302-306, is presented. Of course, the three bollards are presented as an illustrative number and should not be construed as limiting in any way. In any particular tracking system configuration, one or more bollards may be present.

In addition to the bollards 302-306, the tracking system 300 includes an operator console 308 in communication with a base station 310 over a communication network 312. The operator console 308 provides modules for the administration and configuration of the tracking system 300. Moreover, information recorded/read by the various bollards 302-306 are ultimately, if not instantly, transferred to the operator console 308. While not shown in FIG. 3A, the operator console 308 also includes modules that allow it to further interface with external devices and computers, directly or over the network 312, such that event information may be retransmitted and/or displayed.

The base station 310 is a component that facilitates communication between the operator console and the bollards 302-306. In one embodiment, the base station 310 comprises a wireless communication transceiver to wirelessly send information to and receive information from the bollards 302-306. As indicated above, each bollard includes a wireless interface component 220 that is used to communicate with the operator's console via the base station 310.

While the base station 310 is illustrated as external to the operator console 308 and communicates therewith over a network 312, this is just one embodiment and should not be viewed as limiting on the present invention. For example, in an alternative embodiment, the base station 310 may be incorporated as a hardware or software component (or a combination of the both) within or partially within the operator console 308. However, as there may be issues with regard to the effective transmission ranges of the bollards 302-306, a separate base station 310 located in the transmission range of the bollards 302-306 may be desirable. Still further, while the tracking system 300 is illustrated as including only one base station 310, this is for illustration purposes only and should not be viewed as limiting upon the present invention. In any particular configuration, one or more base stations 310 may be deployed in an event tracking system 300 in order to facilitate communications between the bollards 302-306 and the operator console 308.

It should be appreciated that while bollards must be placed at certain locations for event tracking purposes, base stations might not be so easily moved and/or deployed. In this regard, FIG. 3B illustrates yet another tracking system 340 configured such that not all bollards 302-306 are in direct communication with the base station 310. As shown in FIG. 3B, while bollards 304 and 306 are in direct wireless communication with base station 310, bollard 302 is not. This, of course, may be due to any number of reasons including the effective transmission range of the wireless interface component 220 in bollard 302, an obstruction that blocks communications between the bollard 302 and the base station 310, electromagnetic interference, and the like. However, when all bollards are not in direct communication with the base station 310, some bollards may be configured to relay information from one bollard to the base station or to another bollard. For example, FIG. 3B illustrates bollard 304 acting as a relay for bollard 302, which may currently be outside of communication range of base station 310.

As yet another illustrative communication, bollards may also simply record information for subsequent transfer or downloading. FIG. 3C illustrates another tracking system 360 configuration in which bollard 302 is out of communication range of both the base station 310 as well as bollard 304. In this circumstance (or according to preference), a bollard, such as bollard 302, may be configured to record information from the RFID tags and store it temporarily in storage 224. At some point later, that information may be transferred to removable media in the removable media drive 226 and physically transferred to the operator console 308. Of course, in another exemplary configuration (though not shown), some bollards may be in wired or wireless communication with a base station 310, some bollards may be acting as wireless relays, such as shown in FIG. 3B, and some bollards may record information for subsequent downloading as shown in FIG. 3C.

Figure 4:
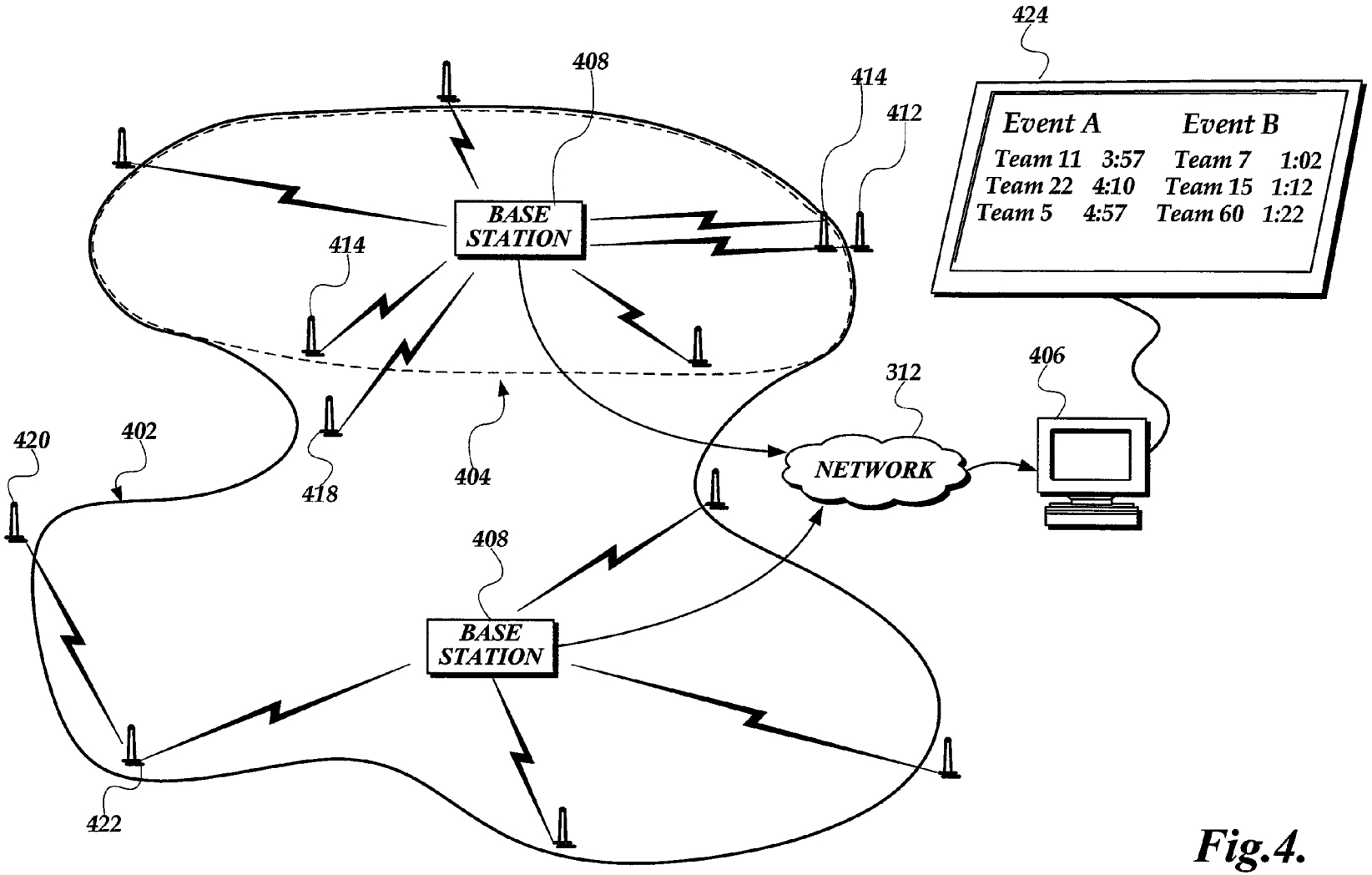
FIG. 4 is a pictorial diagram illustrating an exemplary configuration of a tracking system for reading RFID tags from multiple paths.

Bollards can be configured to function in or record information for more than one tracking event simultaneously. Turning to FIG. 4, FIG. 4 is a pictorial diagram illustrating an exemplary configuration of a tracking system for reading RFID tags from multiple paths. In particular, FIG. 4 illustrates two exemplary paths 402 and 404 corresponding to two separate events being managed by the event tracking system 400. As shown in FIG. 4, the illustrated event tracking system 400 includes an operator console 406, and two base stations 408 and 410 connected to the operator console via a network 312. The event tracking system 400 also includes numerous bollards, such as bollards 412-422, located at various positions on the two event paths 402 and 406.

As suggested by FIG. 4, a single event tracking system, such as event tracking system 400, can be configured to monitor one or more events. Thus, while FIG. 4 illustrates that the event tracking system 400 services two events, one corresponding to path 402 and one corresponding to path 404, it is illustrative and should not be viewed as limiting upon the present invention.

In addition to managing the events, the operator console can output display results regarding the events to a display device or provide event information to other computers or devices for use. As shown in FIG. 4, the operator console 406 outputs information to display device 424 regarding progress in both events that are currently being managed by the event tracking system 400.

In addition to the operator console managing multiple events, bollards may also be configured to record information for multiple events. For example, as both path 402 and path 404 pass by bollards 412 and 414, these two bollards may be configured to record tags passing by for both events corresponding to paths 402 and 404. On the other hand, bollards may be configured to read only tags corresponding to a particular event. Thus, bollard 416 may be configured to read and record information from tags corresponding to the event on path 404 and bollard 418 may be configured to read only tags corresponding to the event on path 402, even though both bollards may be within range of both paths 402 and 404 to read tags corresponding to both events. In other words, bollards ignore tags corresponding to events for which the bollard is not configured/programmed to record which come within the reading range of a bollard.

Even when bollards are configured to read tags for a single event, the bollards may report that information through the same base station. In continuing the example from above, while bollards 416 and 418 are configured to read tags corresponding to different events, both bollards report their read/recorded information to the operator console via base station 408.

In addition to ignoring tags that do not correspond to an event for which the bollard is configured, the event tracking system 400 may be configured to ignore recordings of tags that are not possible. For example, assuming that under the best conditions a participant requires at least one minute to circumnavigate path 404, if a tag were read by bollard 412 a first time, a second subsequent reading by bollard 412 within a few seconds would be discarded. According to various embodiments, the logic to ignore or discard impossible results can be implemented within a bollard or within the operator console 406.

Quite frequently, a particular location on an event path may be congested, i.e., experience a large number of participants at the same time. According to aspects of the present invention, multiple bollards may be placed at a given location to cooperatively record the tags that pass that location. As shown in FIG. 4, bollards 412 and 414 are placed at a congested location and cooperatively read tags for events corresponding to paths 402 and 404. In at least one embodiment, the operator console is configured to resolve the occasions when at least two bollards, such as bollards 412 and 414, read the same tag at approximately the same time. Alternatively, each bollard, as part of recording a tag passing within its read range, may write information to the tag such that another cooperative bollard can ignore the presence of the tag in approximately the same time such that the tag's presence at that time is recorded only once.

In yet another alternative embodiment, a bollard may be configured to write event-related information to an RFID tag instead of (or in addition to) recording information in storage. Correspondingly, a bollard may be configured to read the information recorded by another bollard. For example, while bollard 420 is illustrated as being configured to relay its information through bollard 422 to the base station 408, in an alternative embodiment (not shown), bollard 420 may be configured to record event-related information to the RFID tag storage 504 (FIG. 5) of event-related tags that fall within communication range of the bollard. Correspondingly, another bollard, such as bollard 422, could read the event-related information recorded to a tag by bollard 420 and relay that information to the operator console 406.

While FIG. 4 illustrates that the operator console 406 drives the display of the various events being tracked, in alternative embodiments, when information is recorded to RFID tags, one or more bollards may be configured to carry out various functions of an event typically accomplished by the operator console. For example, in an alternative embodiment (not shown), bollards 412 and 414 may be configured to update results on the display device 424, such as current lap, times, whether a participant has completed a course, and the like. Still further, while bollards are generally advantageously highly portable, in various circumstances it is also advantageous to permanently (or semi-permanently) fix one or more bollards at a particular location. For example, it may be advantageous to permanently affix one or more bollards at each entrance of a facility and configure these bollards to provide continuous, year-round operation in tracking persons that enter via an RFID tag.

Figure 5:
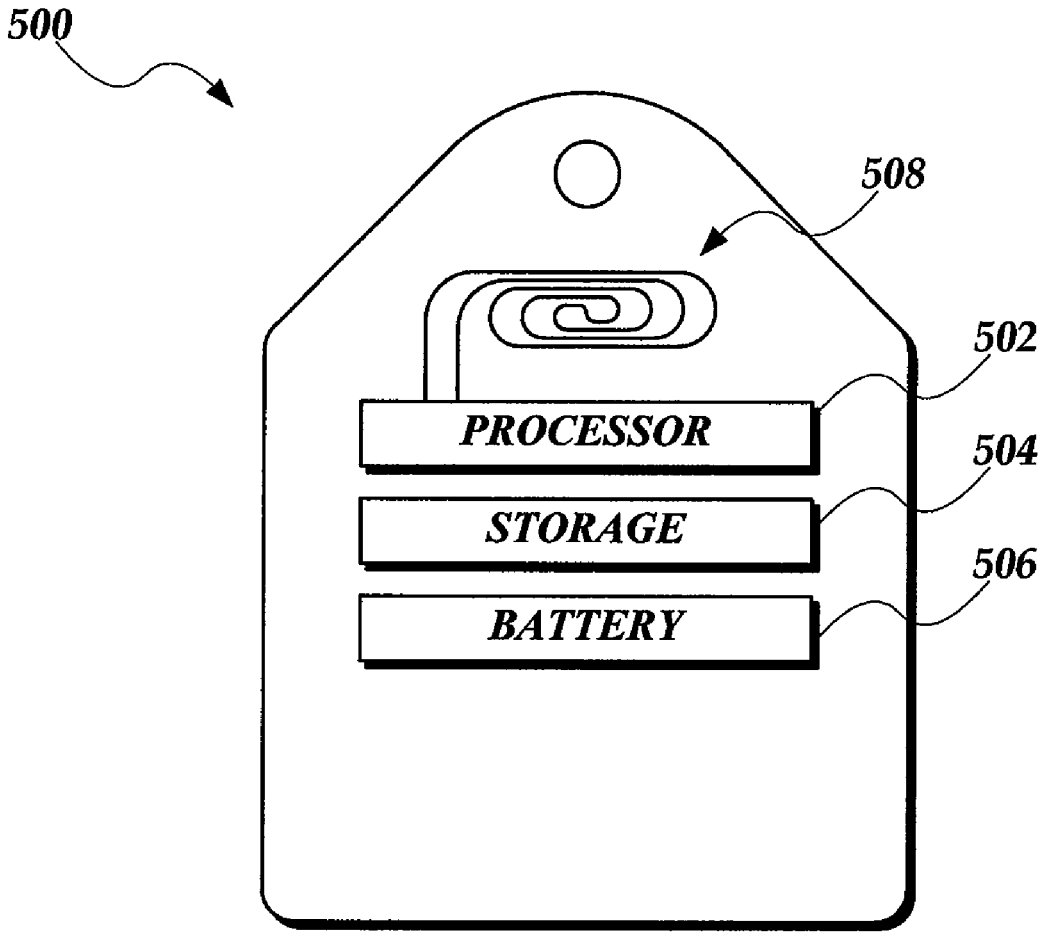
FIG. 5 is a block diagram illustrating components of an exemplary semi-passive RFID tag formed according to aspects of the present invention.

In order to improve the effective reading range of the bollards, in one embodiment, semi-passive tags are used. FIG. 5 is a block diagram illustrating exemplary components of a semi-passive RFID tag. As shown in FIG. 5, the semi-passive RFID tag includes a processor 502 and optional storage 504. In order to ensure that tags are not altered, and that only tags corresponding to the configured events are recorded, various information, including encrypted information, may be stored in the storage 504.

Similar to passive RFID tags which are known in the art, semi-passive tags remain inactive/passive, i.e., do not actively broadcast information, until they are activated by entering the range of a reader. Active tags, in contrast, include a power source and constantly broadcast their information. However, in contrast to passive tags, once activated, a semi-passive tag, such as tag 500, utilizes an internal battery 506 to bolster the signal output by its antennae 508. Since the output of the tag 500 does not rely upon the inductive energy of the reader/bollard, the effective range of a semi-passive tag can reach up to 150 feet.

While not shown in the figures described above, in addition to events such as races and rallies, bollards may be utilized in other capacities. In one embodiment, bollards may be strategically located at access and egress points with regard to a facility or structure where monitoring who enters and leaves is important. For example, one or more bollards may be placed on the entrance/exit of a cruise ship to monitor who is on the vessel and who is not while in a port of call. Information regarding time of access and egress may be recorded and transferred to an operator console or stored on the tags as they pass within communication range of the bollards.

Of course, the bollards may further be used in conjunction with controlling access to an event and/or facility, such that tags corresponding to authorized personnel enable access, or at least provide an indication that the person in possession of the tag is authorized to enter or leave. For example, when a tag corresponding to an authorized person and/or VIP comes within communication range of a bollard, the bollard could be configured to provide audio and/or visual feedback indicating authorization. Alternatively, the bollard may be configured to transmit a signal that would automatically trigger access for the possessor, such as by unlocking a door. In these scenarios, VIPs are provided with "hands free" access if they simply have their tag in their possession.

While illustrative embodiments have been illustrated and described, it will be appreciated that various changes can be made therein without departing from the spirit and scope of the invention.

The embodiments of the invention in which an exclusive property or privilege is claimed are defined as follows:

1. A plurality of highly portable vertically-standing RFID tag readers (bollards) for use in athletic events, such as marathons, each of the bollards comprising:

a vertical element for supporting an internal RFID tuner component above a surface on which the bollard is placed during use;

a base element located at the bottom of the vertical element for providing stability to the vertical element when the bollard is placed on the surface; and an internal RFID tuner component comprising a plurality of components all of which are located within the bollard for reading an RFID tag, the plurality of components including:

a power system for providing power to the powered components of the internal RFID tuner component;

a processor for directing the functions of the bollard with regard to an athletic event in which the bollard is participating;

a tuner component configured to read RFID tags that come within the RFID communication range of the bollard; and a wireless interface component configured to provide wireless communication to and from the bollard, whereby if a bollard is not in direct communication with a base station, the bollard is configured to relay information to the base station through another bollard.

2. The plurality of highly portable bollards of claim 1, wherein the plurality of components further includes a readable media drive suitable for storing information regarding the athletic event in which the bollard is participating.

3. The plurality of highly portable bollards of claim 1, wherein the plurality of components further includes a component for providing human-perceptible feedback with regard to reading an RFID tag.

4. The plurality of highly portable bollards of claim 3, wherein the component for providing human-perceptible feedback comprises an audio component for providing audio feedback with regard to reading an RFID tag.

5. The plurality of highly portable bollards of claim 4, wherein the component for providing human-perceptible feedback further comprises a light component for providing visual feedback with regard to reading an RFID tag.

6. The plurality of highly portable bollards of claim 1, wherein the power system comprises a power management component and a battery, and wherein the power management component directs the power system to provide power to other components of the bollard at various levels corresponding to power states.

7. The plurality of highly portable bollards of claim 1, wherein each of the bollards is configured according to the athletic event, and wherein the bollards only record information from RFID tags, read by the tuner component, corresponding to the athletic event.

8. The plurality of highly portable bollards of claim 7, wherein each of the bollards is configured according to a plurality of athletic events, and wherein the bollards only record information, read by the tuner component, corresponding to any one of the plurality of athletic events.

9. The plurality of highly portable bollards of claim 1, wherein each of the bollards is configured with an anti-collision protocol allowing the bollard to read a plurality of tags falling simultaneously within the reading area of the bollard.

10. The plurality of highly portable bollards of claim 1, wherein the plurality of components further comprises an environmental sensor component for determining environmental conditions affecting the bollard or its components.

11. An event tracking system for tracking participants in an event using an RFID tag, the event tracking system comprising:

(a) a plurality of highly portable vertically-standing RFID tag readers (bollards) for recording the RFID tags of event participants, each of the bollards comprising:

(1) a vertical element for supporting an internal RFID tuner component above a surface on which the bollard is placed during use;

(2) a base element located at the bottom of the vertical element for providing stability to the vertical element when the bollard is placed on the surface; and (3) an internal RFID tuner component comprising a plurality of components all of which are located within the bollard for reading an RFID tag, the plurality of components including:

(i) a power system for providing power to the powered components of the internal RFID tuner component;

(ii) a processor for directing the functions of the bollard with regard to an athletic event in which the bollard is participating;

(iii) a tuner component configured to read RFID tags that come within the RFID communication range of the bollard; and (iv) a wireless interface component configured to provide wireless communication to and from the bollard;

(b) an operator console for managing an event and its participants according to the information provided by the plurality of bollards; and (c) a base station, wherein the base station is communicatively coupled to the operator console, and wherein the base station is communicatively coupled to at least some of the plurality of bollards in a wireless manner, whereby if a bollard is not in direct communication with the base station, the bollard is configured to relay information to the base station through another bollard.

12. The event tracking system of claim 11, wherein a first bollard is configured to record information relating to RFID tags of event participants on a readable media suitable for physical distribution to the operator console.

13. The event tracking system of claim 11, wherein the operator console is configured to simultaneously manage a plurality of events and corresponding participants.

14. The event tracking system of claim 13, wherein at least one bollard is configured to record information regarding RFID tags of participants of a plurality of events.

15. The event tracking system of claim 14, wherein each bollard is configured according to one or more events such that the bollard records information only from RFID tags corresponding to the one or more events.

16. The event tracking system of claim 11 further comprising a display device, and wherein the operator console outputs information related to the event for display to the display device.

17. The event tracking system of claim 11, wherein the bollards are configured to read semi-passive RFID tags of participants.

18. The event tracking system of claim 11, wherein at least one bollard is configured to write event-related information to RFID tags that fall within the communication range of at least one bollard for subsequent reading by another bollard.

19. The event tracking system of claim 11, wherein at least one bollard is permanently fixed at an event-related location for automated continuous operation.

20. The event tracking system of claim 11, wherein at least one bollard is further configured to receive and record information related to radio wave transmitting devices.

* * * * *